US005507459A

United States Patent [19]

Kiera

[11] Patent Number: 5,507,459

[45] Date of Patent: Apr. 16, 1996

[54] SINGLE PIECE MOUNTING DEVICE FOR USE ON A BULLETIN BOARD

[76] Inventor: Heiko-Roberto Kiera, 222 Lake Dr., Oviedo, Fla. 32765

[21] Appl. No.: 267,260

[22] Filed: Jun. 29, 1994

[51] Int. Cl.[6] ..... A47B 96/06

[52] U.S. Cl. ..... 248/218.2; 24/DIG. 10; 248/216.1; 248/218.1

[58] Field of Search ..... 248/303, 218.2, 248/218.1, 216.1; 24/600.9, 67.11, 369, 370, 598.1, DIG. 10

[56] References Cited

U.S. PATENT DOCUMENTS

| | | | |
|---|---|---|---|
| 306,294 | 10/1884 | Thurston | 248/218.2 |
| 372,099 | 10/1887 | Williamson | 248/218.2 |
| 1,099,741 | 6/1914 | Ford | 248/218.2 X |
| 1,210,610 | 1/1917 | Dehn | 248/218.2 X |
| 1,567,851 | 12/1925 | Lorber | 24/600.9 |
| 2,510,508 | 6/1950 | Mayer | 24/67.11 |
| 3,861,015 | 1/1975 | Hooven . | |
| 4,244,085 | 1/1981 | Tsao-Tsung . | |
| 4,903,379 | 2/1990 | Uchtman . | |
| 5,029,788 | 7/1991 | Hoskinson | 248/303 X |
| 5,067,205 | 11/1991 | Chen et al. . | |
| 5,148,581 | 9/1992 | Hartmann . | |
| 5,170,535 | 12/1992 | Strong . | |

FOREIGN PATENT DOCUMENTS

| | | | |
|---|---|---|---|
| 545158 | 2/1932 | Germany | 248/216.1 |

*Primary Examiner*—J. Franklin Foss

[57] ABSTRACT

A mounting device representing a combination paper clip and a pointed mounting member therefor, designed to be appended to a bulletin board or other mounting surface. This novel mounting device is of elongate configuration and involves a resilient wire having a plurality of bends therein, with selected ones of the bends defining a pair of elongate, coplanar loops. A first of the loops is slightly larger than the second of the loops, with the side portions of the second loop residing essentially within the confines of the side portions of the first loop. An article-receiving location is defined between the loops, adjacent one end of the device. The article-receiving location is adapted for receiving a relatively flat item inserted between the loops, with the inherent resilience of the wire tending to hold the flat item in a secure manner. One of the side portions of the first loop serves as the mounting means for a pressure-applying member located at an essentially opposite end of the mounting device from the article-receiving location. A pointed mounting member is operatively associated with the pressure-applying member and disposed at essentially a right angle thereto. The pointed mounting member is of a length to extend beyond the plane of the loops and by virtue of its position, when pressure is applied to the pressure-applying member, the pointed mounting member is caused to penetrate the mounting surface and be retained therein.

19 Claims, 4 Drawing Sheets

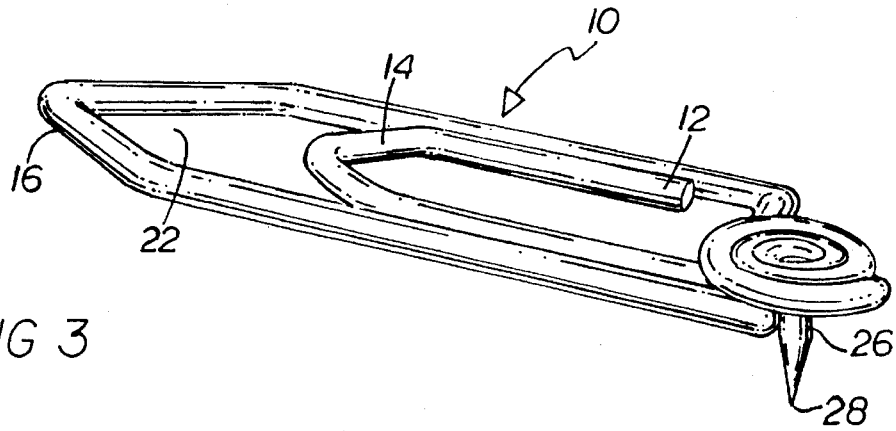
FIG 3
FIG 4
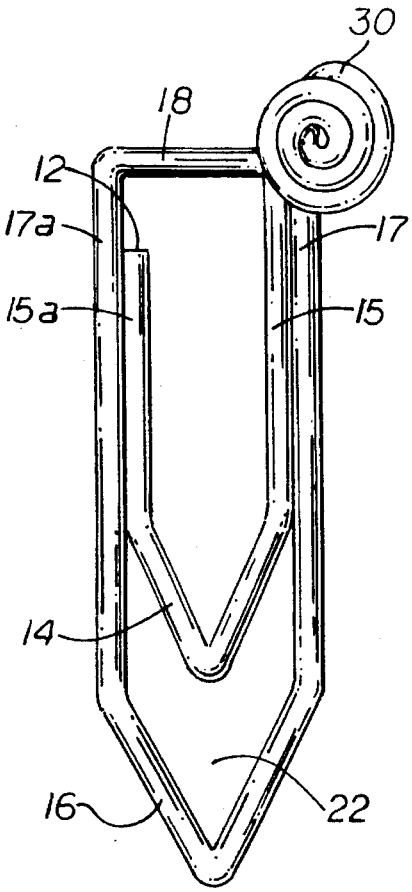
FIG 5
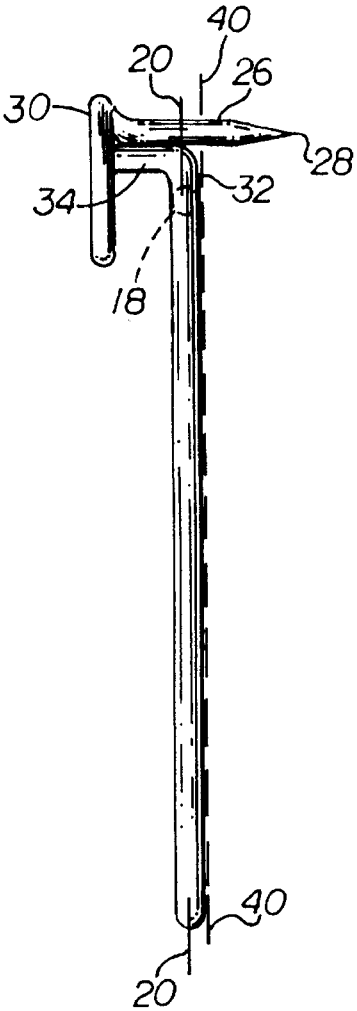

SINGLE PIECE MOUNTING DEVICE FOR USE ON A BULLETIN BOARD

BACKGROUND OF THE INVENTION

For many generations now, it has been well known to mount announcements, notices, bulletins, schedules, posters, postal cards, photographs, lists and the like on bulletin boards, cork boards, panels, walls and other mounting surfaces, typically accomplished by the use of push pins, thumb tacks, and other mechanical means. It has been usual practice to create holes in the upper corners of such announcements, notices, bulletins and the like, but in many instances, it has been appropriate or desirable to create mounting holes in other portions of the mounted item as well.

In the instance in which the items being mounted have little long term value, it has been acceptable to place a plurality of mounting holes in the corners of the items, but in the event the item being mounted or displayed has intrinsic value, it has been undesirable to place mounting holes in the item, with this being particularly true in the case of photographs, color maps, certain announcements and the like.

From time to time it becomes desirable to mount an envelope, folded letter, folded map or the like on a bulletin board, to be picked up by the intended recipient, and in such an instance, it is usually undesirable to penetrate the envelope with a push pin or tack, for in the case of an envelope., the mounting hole may pierce an important part of the contents of the envelope. It has accordingly been difficult to mount such items on a bulletin board, utilizing conventional means.

It was in an effort to overcome the disadvantages of the prior art arrangements that the present invention was created.

SUMMARY OF THE INVENTION

A mounting device representing a combination paper clip and a pointed mounting member therefor, designed to be appended to a bulletin board, panel or other mounting surface. My novel mounting device is of elongate configuration and involves a resilient wire having a plurality of bends therein, with selected ones of the bends defining a pair of elongate, coplanar loops. One of the loops resides essentially within the confines of the other, and is of shorter length than the other. An article-receiving location is defined between the loops, with the inherent resilience of the wire tending to hold the loops in the same plane. Because of the inherent springiness of the wire utilized, a relatively flat item placed between the loops is snugly held in such location, in a non-damaging manner.

The pointed mounting member is defined adjacent the opposite end of the mounting device from the article-receiving location, with the pointed mounting member residing substantially in a right angle relationship to the plane of the loops, and being of a length to penetrate the intended mounting surface and be retained therein.

Advantageously, an enlarged member of generally flat or slightly rounded configuration is provided in a highly effective relationship to the pointed mounting member, with this enlarged member not only providing a convenient means enabling the user to grasp the novel mounting device for installation on the mounting surface, but also making it possible for the user to be able to apply sufficient pressure as to cause the pointed mounting member to penetrate the mounting surface and be retained therein.

Because of this highly advantageous arrangement, I can provide a highly effective means for mounting a relatively flat article such as an envelope, photograph, note, bulletin, message, or the like on a suitable mounting surface, such as a bulletin board, without placing a hole or causing any damage to the item to be hung.

A primary object of this invention is therefore to provide a mounting device representing a combination paper clip and pointed mounting member of inexpensive yet highly advantageous construction, that is admirably suited for use on bulletin boards, cork boards, walls and other surfaces.

Another object of this invention is to provide a reusable mounting device representing a combination paper clip and pointed mounting member of inexpensive construction that enables an envelope, photograph, post card, folded map or any of a variety of other relatively flat items to be mounted in a non-damaging manner on a bulletin board, cork board, wall or other mounting surface.

Still another object of my invention is to provide an elongate mounting device having a pair of coplanar loops defining therebetween, an article-receiving location, with a pointed mounting member constructed of the same material as the mounting device and disposed in a right angle relationship thereto, so as to be positioned for direct insertion into a bulletin board or the like, and thereafter reused a large number of times.

Yet another object of my invention is to provide an elongate mounting device utilizing a pointed mounting member at one end, and a pair of coplanar loops at the other end, with the loops defining therebetween an article-receiving location such that a relatively flat item such as a note, announcement, bulletin or the like can be conspicuously displayed without it being defaced by a hole being placed therein, such as is customarily necessary when a thumb tack or push pin is utilized for posting a note or announcement on a bulletin board or wall.

It is yet still another object of my invention to provide an article mounting device involving the use of a pair of coplanar loops, having an enlarged, generally flat member supported above the plane of the coplanar loops, configured so as to be readily grasped preparatory to the user endeavoring to insert the pointed mounting member of the device into the bulletin board or other mounting surface.

It is yet still another object of my invention to provide a generally flat head member supported adjacent the coplanar loops, that in accordance with one embodiment of my invention is placed generally above the pointed mounting member but with its center offset therefrom in such a manner so as to make a substantial part of the peripheral portion of the coiled member readily available to be grasped by the user preparatory to the user inserting the pointed mounting member of the device into the bulletin board or other mounting surface.

It is yet still another object of my invention to provide a single piece mounting device for use in removably securing a relatively flat item on a bulletin board or the like, that is of inexpensive construction and reusable.

These and other objects, features and advantages will be more apparent as the description proceeds.

BRIEF DESCRIPTION OF DRAWINGS

FIG. 1 is a perspective view of a first embodiment of a mounting device for a photograph, notice, post card, envelope or the like in accordance with this invention, which device is configured to be easily grasped by the user in the manner illustrated in this figure, with the pointed member of the mounting device then to be inserted into a bulletin board or the like;

FIG. 3 is a perspective view, to a larger scale, of a first embodiment of a mounting device in accordance with this invention, revealing selected bends defining a pair of elongate, coplanar loops, with an article-receiving location defined between such pair of loops, and with a tightly wound pressure-applying member defined on the end of the device opposite from the article-receiving location;

FIG. 4 is a plan view of the mounting device shown in FIG. 3, showing a desired offset relationship of the head or pressure-applying member to the pair of coplanar loops;

FIG. 5 is an edge view of the device depicted in FIG. 4, revealing the use of a pointed mounting member disposed in a perpendicular relationship to the pair of loops, with the pointed member being located generally under, but nevertheless offset to a desirable extent from a central portion of the head member or pressure-applying member;

DETAILED DESCRIPTION

Figure 1:
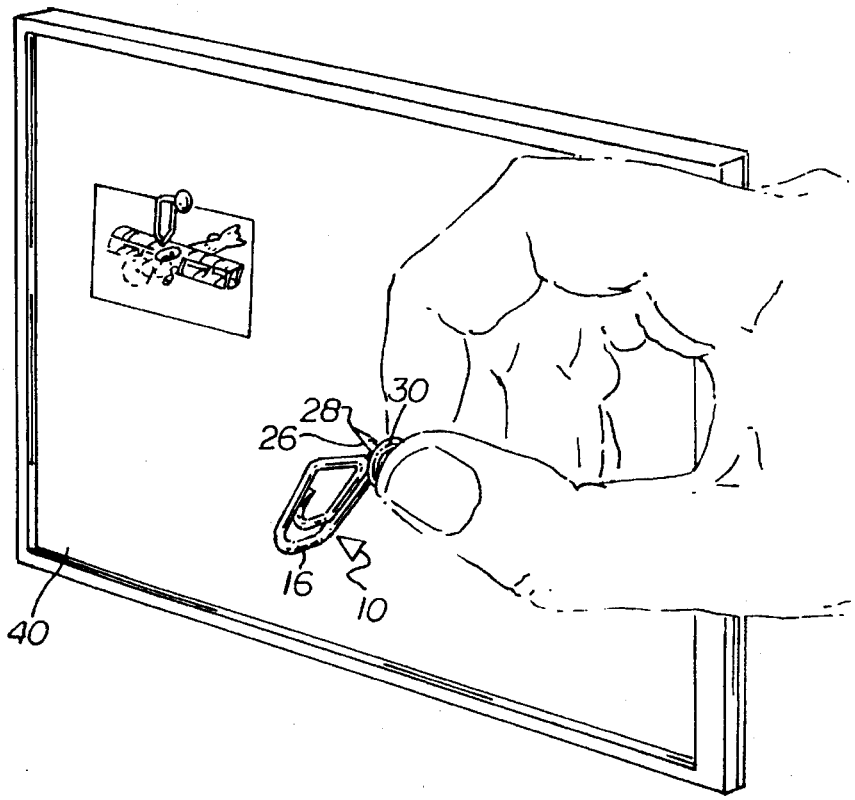

In FIG. 1 I reveal a first embodiment of a mounting device 10 representing an advantageous combination of a paper clip and a pointed mounting member therefor, designed to be appended to a bulletin board 40 or other mounting surface, and to serve as a highly suitable means for displaying a post card, notice, bulletin, photograph, envelope or any of a variety of other relatively flat items. It will be noted from FIG. 1 that my novel mounting device 10 has a pointed mounting member 26 with a sharply pointed tip 28, and a head member 30 adapted to be held between the thumb and forefinger of the user as he or she goes about inserting my device into a bulletin board, panel or the like. After such insertion, my novel mounting device forms an ideal, non-damaging support for a post card, envelope, photograph, note, message or other relatively flat item or document inserted between loops provided on the end of my device substantially opposite from the pointed mounted member 26. My novel device is clearly re-usable for a large number of times, in the same general manner as a paper clip or push pin is reusable.

Figure 2:
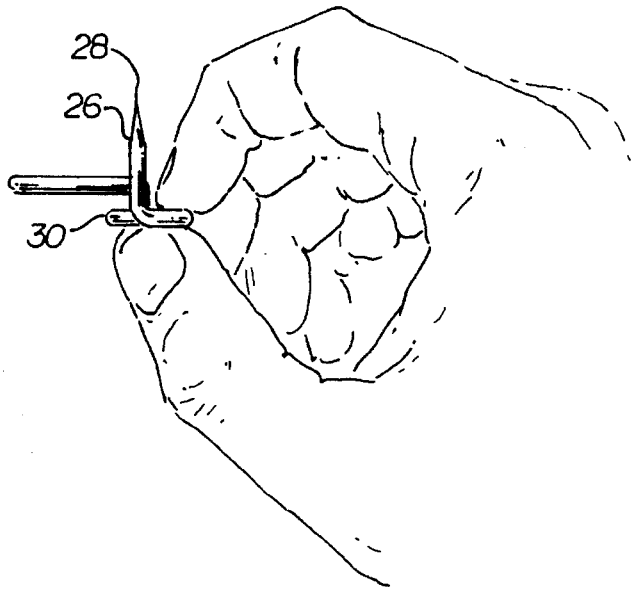
FIG. 2 is a side view generally along the lines of FIG. 1, but with the head member or pressure-applying member of my mounting device being held by the user in such a manner as to show the highly desirable offset relationship of the pointed mounting member to the head or pressure-applying member.
Figure 12:
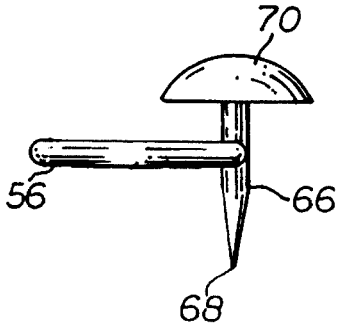
FIG. 12 is a view from the end of the mounting device of FIG. 10 remote from the pressure applying member.
Figure 13:
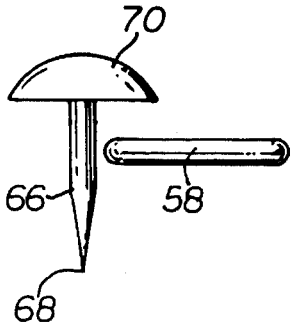
FIG. 13 is a view from the end of the mounting device of FIG. 10 close to the pressure applying meter.

From the orientation of my mounting device as depicted in FIG. 2, it will be seen that the pointed mounting member 26 is supported from the head member 30, with this latter member being advantageously configured so as to be easily held between the user's thumb and forefinger. The pointed mounting member can be disposed in an essentially centered relationship with the head member 30, so that in an easily understood manner, pressure applied to the head member can be directly transferred to the pointed mounting member, to cause it to penetrate for a sufficient distance into the bulletin board or other mounting surface. Illustrated in the embodiment depicted in FIGS. 12 and 13 is a centered relationship of the pointed mounting member to the head member.

In a preferred instance, however, the pointed mounted member 26 is disposed in a non-centered relationship to the head member 30, so as to cause an ample portion of the head member 30 to be provided for the user to grasp as he goes about inserting the pointed mounting member 26 into the bulletin board, panel or the like. In FIGS. 2, 5, 7 and 9 the offset or non-centered relationship of the pointed mounting member 26 to the head member 30 is illustrated. This important aspect of my invention will be discussed at greater length hereinafter.

With reference now to FIGS. 3 through 5, this first embodiment of my novel mounting device will be seen to be of elongate configuration, and to involve a resilient wire 12 having a plurality of bends therein, with selected ones of such bends defining an adjacent pair of elongate, coplanar loops. Those familiar with the construction of paper clips know that in many instances, paper clips may be formed utilizing wide radius loops extending for 180°, and in accordance with some embodiments of my invention, I may use such wide radius loops.

In FIGS. 3 through 5 as well as in certain other figures, however, it will be noted that my novel mounting device 10 may utilize loops that are somewhat pointed, rather than involving smooth, wide radius curves, although the utilization of smooth, wide radius loops is quite in keeping with this invention. It is important to note that loop 14 resides essentially within the confines of the slightly larger loop 16, and is somewhat shorter than loop 16. Common to inner loop 14 and outer loop 16 is base loop 18, located at the opposite end of the mounting device from the loops 14 and 16o Loops 14, 16 and 18 may be regarded as residing in a common plane 20—20; note FIG. 5.

Defined between the inner loop 14 and the outer loop 16 is an article-receiving location 22, with the inherent resilience of wire 12 tending to hold the loops 14 and 16 in the common plane 20—20. As will be obvious to those skilled in this art, the article-receiving location 22 is adapted for receiving a post card, envelope, photograph, note, message or other relatively flat item inserted between the loops, with such post card, envelope, photograph, note or the like being clasped tightly, in a non-damaging manner, by the springiness of the adjacent loops 14 and 16. In other words, the inherent resilience of the wire is effective for holding the flat article or item in a secure yet non-damaged manner.

It is thus to be seen that the outer loop 16, also known as the first loop, is slightly larger than the inner loop 14, also known as the second loop, with the side portions of the second loop residing essentially within the confines of the side portions of the first loop. The article-receiving location 22 has already been mentioned as being defined between the loops, adjacent one end of my novel mounting device.

It is to be noted that leg 17, forming a part of the outer loop 16, is parallel to the leg 15, forming a part of the inner loop 14. Similarly, the leg 17*a*, also forming a part of the outer loop 16, is parallel to the leg 15*a*, also forming a part of the inner loop 14. As will be described hereinafter, an extension of the leg 17 is operatively associated with the head member 30, forming in conjunction with the short horizontal member 32 and the short vertical member 34, the support for the head member 30.

The pointed mounting member 26 is operatively associated with the pressure-applying member 30 and disposed at essentially a right angle thereto. The pointed mounting member is of a length to extend an appropriate distance beyond the plane of the loops, and by virtue of its position, when pressure is applied to the pressure-applying member 30, the pointed mounting member 26 is caused to penetrate the mounting surface, depicted at 40 in FIG. 5, and to be retained therein.

Significant to this invention is the positioning of the pointed mounting member 26, which in this embodiment is defined adjacent the end of the right side of the mounting device 10 as viewed in FIGS. 3 through 5. In other words, the pointed mounted member 26 is in the general vicinity of the base loop 18, but because of the short horizontal member 32, it is supported from the leg 17 at a location spaced somewhat away from the base loop 18. The pointed mounting member 26 is of course on an opposite end of the mounting device 10 from the previously-described article-receiving location 22.

The pointed mounting member 26 will be noted from FIGS. 3 and 5 to reside substantially in a right angle relationship to the plane of the loops 14, 16 and 18, and at the remote end of the pointed mounting member is a sharply pointed tip 28. It is to be noted that the sharp tip 28 is normally not to be used for penetrating the note, photograph, envelope, announcement or bulletin, thus advantageously avoiding damaging or marring the item to be displayed on the bulletin board. For example, it might be highly undesirable for a hole to be made in one corner of a photograph. The sharp tip 28, however, can be used for penetrating unimportant items such as notes, notices and the like, where slight damage to such items is not of consequence.

At such time as the sharply pointed tip 28 has started to penetrate the bulletin board, panel or the like, the user then places his or her thumb on the head member 30 and applies sufficient pressure as to cause the entry of the member 26 for a desired depth into the bulletin board or other mounting surface. It is for this reason that I may refer to the member 30 as the pressure-applying member.

As previously mentioned, the pointed mounting member 26 may be mounted below the enlarged, generally flat head member 30, in a centered relationship thereto, as depicted in FIGS. 12 and 13, but in the preferred instance, the pointed mounting member is in a non-centered or offset relationship to the head member, thus to provide an increased amount of the surface of the head member for grasping by the user. This was of course made clear by FIG. 2 and certain subsequent figures.

The head member or pressure-applying member 30 may be a tightly coiled member created as a single loop from the same individual piece of wire 12 as the wire used to create the loops 14, 16 and 18 and the other parts of my novel mounting device 10; note FIGS. 3 through 5. The coiled head member 30 is disposed in an offset relationship to, but generally parallel to, the previously-described plane 20—20 in which the loops 14, 16 and 18 reside. Extending down from the enlarged, coiled head member 30 in the manner depicted in FIG. 5 is the previously-mentioned relatively short vertical member 34 that is utilized to support the head member 30 in an offset relationship to the plane of the loops 14, 16 and 18. As mentioned hereinbefore, the short vertical member 34 is connected to a short horizontal member 32 forming an extension of the leg 17 that is operatively associated with the outer loop 16. As a result of this construction, the pointed mounting member 26 is located somewhat away from, or in other words, offset from the base loop 18.

As earlier made clear, of primary consequence to my novel design is the fact that the head member or pressure-applying member 30 is positioned so that it can be readily grasped between the thumb and forefinger in the manner shown in FIGS. 1 and 2, and then the sharply pointed tip 28 of the pointed mounting member 26 easily inserted into the bulletin board, panel or other suitable surface. The bulletin board is shown at 40 in FIGS. 7, 9 and 11 in addition to FIG. 5.

Although the embodiment of my invention illustrated in FIGS. 3, 4 and 5 is made from a single piece of wire, it will be later explained that I am not limited to this construction, for a member serving as the pressure-applying or head member can be secured, such as by brazing, at a location spaced above the portion of my mounting device residing in the common plane 20—20 depicted in FIG. 5. In each instance the essentially flat or slightly rounded upper portion of the head member 30 is in a spaced relationship to, and disposed essentially parallel with, the common plane 20—20, and serves as a convenient means for the user to push upon at such time as my mounting device is being installed in a bulletin board or the like.

As should now be clear, after the sharpened tip 28 of the pointed mounting member has made an initial penetration of the surface of the bulletin board, panel or the like, the user is then able to apply pressure, typically thumb pressure, to the generally flat upper surface of the head member 30, thus to cause the pointed mounting member 26 to penetrate the mounting surface sufficiently deeply as to be firmly retained therein. It is therefore to be seen that the enlarged member 30 functions in the manner of the head of a thumb tack, enabling the user to supply sufficient force as will cause the pointed mounting member to be reliably retained in the selected mounting surface.

Figure 6:
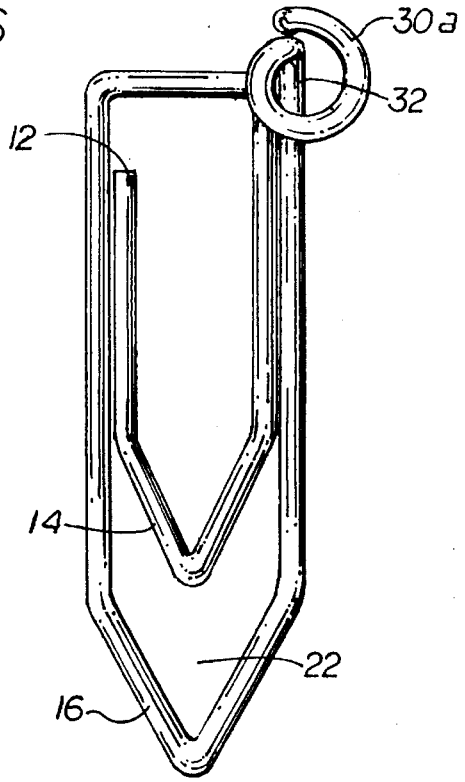
FIG. 6 is a plan view generally along the lines of FIG. 4, but in this instance showing a second embodiment of my invention, this embodiment having a head or pressure-applying member of a less tightly wound type than depicted in FIGS. 3 through 5.
Figure 7:
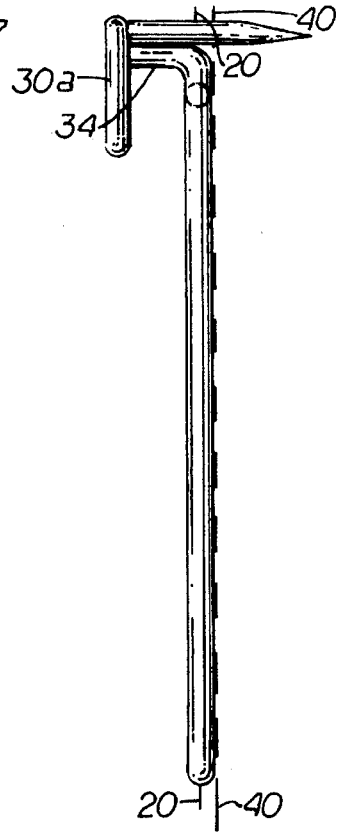
FIG. 7 is an edge view of the embodiment depicted in FIG. 6, with this view showing the manner in which the head member is mounted above the plane of the coplanar loops, and also revealing the distinct offset relationship of the pointed mounting member to the head member or pressure-applying member.

Referring now to the embodiment of my invention shown in FIGS. 6 and 7, it will be noted that instead of utilizing a tightly coiled head member 30 as shown in FIGS. 3 through 5, I now utilize a head member 30*a* involving essentially a single loop of wire. This is but one alternative, for other head members I can use can be in a geometric configuration, such as in the shape of a star, a flower, an initial, or the like. In FIG. 6, it can be readily seen that the coiled head member 30 may be extended in a generally longitudinal direction somewhat beyond the base loop 18, being supported with respect to the plane 20—20 and the loop portions of my device by the short, horizontally disposed member 32. The member 32 is created from the same resilient wire 12 as the rest of the device, and I prefer to regard the member 32 as an extension member. The extension member 32 is of consequence to my design inasmuch as it may be desirable to insert the note, bulletin, photo, post card or the like into the article-receiving location 22 of the mounting device 10 beforehand, before the pointed mounting member 26 is inserted into the bulletin board or other mounting surface. The utilization of the extension member 32 assures that sufficient space will be available for the index finger of the user, as he or she goes about mounting the device 10 on the bulletin board, despite the close proximity of the note, bulletin, photo, post card etc. residing between the loop members 14 and 16.

As in the case of the previous embodiment, the head member 30*a* may be supported in an offset relationship to the plane of the loops 14, 16 and 18 by the relatively short vertical member 34, which extends in an orthogonal relationship to the plane 20—20 in which the loops 14, 16 and 18 are located, this being best seen in FIG. 7. The short upright member 34 is to be understood as forming approximately a 90° angle with the extension member 32, so as to extend essentially vertically upwardly from the member 32, and thus support the coiled member 30 above, yet essentially parallel to, the plane 20—20. It is most important to note from FIG. 7 that the short upright member 34 as well as the pointed mounting member 26 reside in an offset or unbalanced relationship to the center of the coiled member 30, thus to provide an ample amount of the peripheral surface of the member 30 for the user to grasp during the insertion procedure. This was of course illustrated in FIG. 2.

The positioning of the pointed mounting member 26 to the head member 30 may be such that approximately ⅔ of the member 30 is available to be contacted by the forefinger of the user, but quite obviously, I am not to be limited to this. Since on a worldwide basis, approximately 85% of the population is right handed, I have illustrated the overhanging portion of the head member 30 as being positioned for use by a right handed person. Quite obviously, however, I can configure my device such that the head member is positioned for use by a left handed person.

Figure 8:
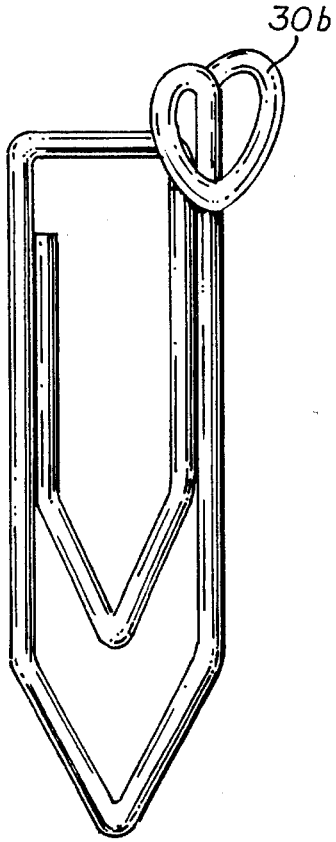
FIG. 8 is a plan view of a third embodiment of my mounting device, with this view being generally along the lines of FIG. 6, and showing a head member or pressure-applying member of a distinct geometric configuration.
Figure 9:
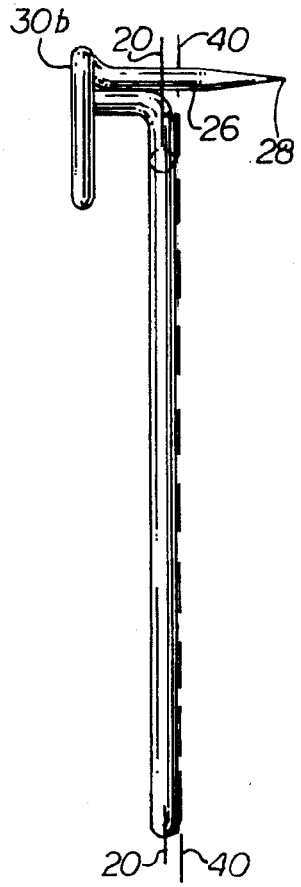
FIG. 9 is an edge view of this third embodiment of my mounting device, showing the offset positioning of the pointed mounting member with respect to the head member or pressure-applying member.

With reference now to the embodiment of my invention depicted in FIGS. 8 and 9, the head member may take the form of a non-circular geometric figure, as shown at 30*b* in these figures.

Figure 10:
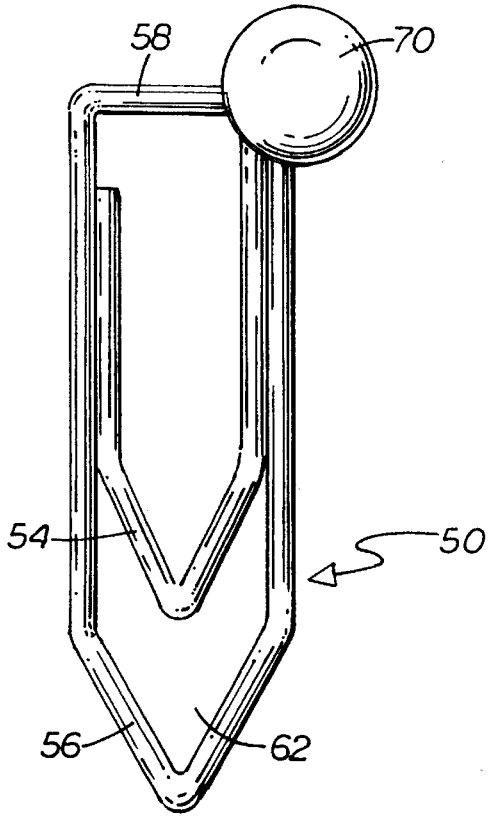
FIG. 10 is a plan view of a fourth embodiment, wherein the enlarged pressure-applying member is of a different material than the wire used in the construction of the basic mounting device.
Figure 11:
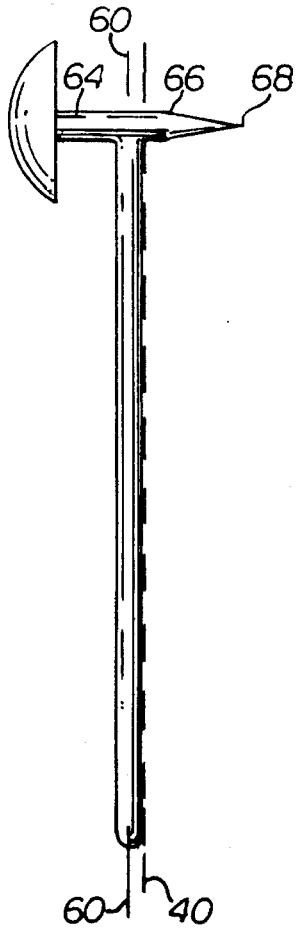
FIG. 11 is an edge view of the embodiment shown in FIG. 10.

Turning now to the embodiment of my invention shown in FIGS. 10 and 11, it is to be noted that the mounting device 50 may utilize loops that are somewhat pointed, with the loop 54 residing essentially within the confines of the slightly larger loop 56, and is somewhat shorter than loop 56. Common to inner loop 54 and outer loop 56 is base loop 58, located at the opposite end of the mounting device from the loops 54 and 56. Loops 54, 56 and 58 may be regarded as residing in a common plane 60—60; note FIG. 11.

Defined between the inner loop 54 and the outer loop 56 is an article-receiving location 62, with the inherent resilience of wire 52 tending to hold the loops 54 and 56 in the common plane 60—60. As will be obvious to those skilled in this art, the article-receiving location 62 is adapted for receiving a post card, envelope, photograph, note, message or other relatively flat document inserted between the loops, with such post card, envelope, photograph, note or the like being clasped tightly in a non-damaging manner by the springiness of the adjacent loops 54 and 56.

Significant to this invention is the positioning of the pointed mounting member 66, which is defined adjacent the end of the mounting device 50 opposite from the article-receiving location 62, or in other words, the pointed mounting member is generally adjacent the base loop 58. The pointed mounting member 66 will be noted to reside substantially in a right angle relationship to the plane of the loops 54, 56 and 58, and is of a length to penetrate a mounting surface such as a bulletin board, panel, wall surface or the like, and to be retained therein. At the remote end of the pointed mounting member is a sharply pointed tip 68. It is to be noted that the sharp tip 68 is normally not to be used for penetrating the note, photograph, envelope, announcement or bulletin, thus advantageously avoiding damaging or marring the item to be displayed on the bulletin board. It can, however, penetrate a note or message of insignificant value.

The pointed mounting member 66 is mounted below the enlarged, somewhat rounded head member 70, also known as a pressure-applying member. The member 70 in this embodiment is typically a single piece of metal or industrial grade plastic that is suitably mounted upon the short vertical member 64. If member 70 is of metal, it may be secured in position by brazing, whereas if it is of industrial grade plastic, it may be held in place by a suitable glue or cement.

The enlarged head member 70 is positioned in such a manner as to represent a readily grasped member or component that is conveniently available to the user at such time as my mounting device is to be installed on a mounting surface. As previously explained in connection with FIGS. 1 and 2, the head member 70 is to be held between the thumb and forefinger preparatory to the user inserting the pointed mounting member 66 into the bulletin board, panel, wall or other mounting surface.

FIG. 12 represents an end view of the embodiment illustrated in FIG. 10, and more particularly, a view from the end of the mounting device where the loop 56 is located. It is apparent from this view that the pointed mounting member 66 is in a centered relationship to the pressure applying member 70.

FIG. 13 is a view from the opposite end of the mounting device shown in FIG. 10, namely, from the end nearest the loop 58, with this view revealing that the pointed mounting member 66 is relatively close to the loop 58.

It now should be abundantly clear that my advantageously configured mounting device can be readily utilized for mounting a wide variety of relatively flat items or articles on a mounting surface in a non-damaging manner. It can be manufactured relatively inexpensively in a variety of configurations, and may be reused indefinitely. As previously mentioned, the pointed mounting member and its associated head member may be disposed adjacent the end of the right side of the mounting device, in an offset relationship to the longitudinal centerline of the device as viewed in FIGS. 4, 6, 8 and 10, but if desired, my novel device could obviously be constructed such that the pointed mounting member and its head member reside on the opposite side of the device from the illustrated position.

I am not to be limited except as required by the scope of the appended claims.

I claim:

1. A mounting device representing a combination paper clip and a pointed mounting member therefor, designed to be appended to a bulletin board or other mounting surface, said mounting device being of elongate configuration and involving a resilient wire having a plurality of bends therein, with selected ones of said bends defining a pair of elongate, coplanar loops, with a first of said loops being somewhat larger than the second of said loops, with the second of said loops residing essentially within the confines of said first loop, an article-receiving location defined between said loops, adjacent one end of said device, with the inherent resilience of the wire tending to hold said loops in the same plane, said article-receiving location being adapted for receiving a relatively flat item inserted between said loops, said pointed mounting member being located adjacent the end of said mounting device essentially opposite from said article-receiving location, said pointed mounting member residing substantially in a right angle relationship to the plane of said loops, and being of a length to penetrate the mounting surface and be retained therein, a generally flat pressure-applying member disposed in an operative relationship to said pointed mounting member, with the plane of said pressure-applying member being substantially perpendicular to said pointed mounting member, and with the user able to apply pressure to the point of said pointed mounting member by pressure asserted upon said pressure-applying member during the installation of said mounting device in a mounting surface.

2. The mounting device representing a combination paper clip and a pointed mounting member therefor as recited in claim 1 in which said pressure-applying member is of generally circular configuration, with said pointed mounting member disposed in a generally centered relationship with respect to said pressure-applying member.

3. The mounting device representing a combination paper clip and a pointed mounting member therefor as recited in claim 1 in which said pressure-applying member is of generally circular configuration, with said pointed mounting member disposed in an offset relationship to the center of said pressure-applying member, thus to make a substantial portion of the periphery of said pressure-applying member available to be conveniently grasped by the user during the installation of said mounting device in a mounting surface.

4. The mounting device representing a combination paper clip and a pointed mounting member therefor as recited in claim 1 in which said pressure-applying member is of a geometric configuration.

5. The mounting device representing a combination paper clip and a pointed mounting member therefor as recited in claim 1 in which said resilient wire is a single wire utilized for creating all portions of said mounting device.

6. The mounting device representing a combination paper clip and a pointed mounting member therefor as recited in claim 1 in which said resilient wire involves a plurality of wires.

7. The mounting device representing a combination paper clip and a pointed mounting member therefor as recited in claim 1 in which said pressure-applying member is made of a component separate from said resilient wire.

8. The mounting device representing a combination paper clip and a pointed mounting member therefor as recited in claim 1 wherein said pressure-applying member is essentially flat.

9. The mounting device representing a combination paper clip and a pointed mounting member therefor as recited in claim 1 wherein said pressure-applying member is somewhat dome shaped.

10. A mounting device representing a combination paper clip and a pointed mounting member therefor, designed to be appended to a bulletin board or other mounting surface, said mounting device being of elongate configuration and involving a resilient wire having a plurality of bends therein, with selected ones of said bends defining a pair of elongate, coplanar loops, with a spaced apart pair of elongate, relatively straight side portions being operatively associated with each loop, a first of said loops being slightly larger than the second of said loops, with the side portions of said second loop residing essentially within the confines of the side portions of said first loop, and with the side portions of said second loop being of shorter length than the side portions of said first loop, an article-receiving location defined between said loops, adjacent one end of said device, with the inherent resilience of the wire tending to hold said loops in the same plane, said article-receiving location being adapted for receiving a relatively flat item inserted between said loops, one of said side portions of said first loop serving as the mounting means for a pressure-applying member located at an essentially opposite end of said mounting device from said article-receiving location, said pressure-applying member being disposed essentially parallel to and spaced from the plane of said loops, and a pointed mounting member operatively associated with said pressure-applying member and disposed at essentially a right angle thereto, said pointed mounting member being of a length to extend beyond the plane of said loops and being positioned to penetrate the mounting surface and be retained therein.

11. The mounting device representing a combination paper clip and a pointed mounting member therefor as recited in claim 10 in which a short extension, located in the plane of said loops and forming a part of one of said side portions of said first loop, serves to support said pressure-applying member in an offset relationship to the main portion of said mounting device.

12. The mounting device representing a combination paper clip and a pointed mounting member therefor as recited in claim 10 in which said pressure-applying member is of generally circular configuration, with said pointed mounting member disposed in an essentially centered relationship with respect to said pressure-applying member.

13. The mounting device representing a combination paper clip and a pointed mounting member therefor as recited in claim 10 in which said pressure-applying member is of generally circular configuration, with said pointed mounting member disposed in an offset relationship to the center of said pressure-applying member, thus to make a substantial portion of the periphery of said pressure-applying member available to be conveniently grasped by the user during the installation of said mounting device in a mounting surface.

14. The mounting device representing a combination paper clip and a pointed mounting member therefor as recited in claim 10 in which said resilient wire is a single wire utilized for creating all portions of said mounting device.

15. The mounting device representing a combination paper clip and a pointed mounting member therefor as recited in claim 10 in which said resilient wire involves the utilization of a plurality of wires.

16. The mounting device representing a combination paper clip and a pointed mounting member therefor as recited in claim 10 in which said pressure-applying member is made of a component separate from said resilient wire.

17. The mounting device representing a combination paper clip and a pointed mounting member therefor as recited in claim 10 in which said pressure-applying member is of a geometric configuration.

18. The mounting device representing a combination paper clip and a pointed mounting member therefor as recited in claim 10 wherein said pressure-applying member is essentially flat.

19. The mounting device representing a combination paper clip and a pointed mounting member therefor as recited in claim 10 wherein said pressure-applying member is somewhat dome shaped.

* * * * *